US007475707B2

(12) United States Patent
Bruynoghe et al.

(10) Patent No.: US 7,475,707 B2
(45) Date of Patent: Jan. 13, 2009

(54) YARN GUIDING DEVICE FOR A WEAVING MACHINE AND WEAVING MACHINE PROVIDED WITH SUCH A YARN GUIDING DEVICE

(75) Inventors: Koen Bruynoghe, De Pinte (BE); Peter Garnett, Morpett (GB)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 41 days.

(21) Appl. No.: 11/331,846

(22) Filed: Jan. 13, 2006

(65) Prior Publication Data

US 2006/0150379 A1 Jul. 13, 2006

(30) Foreign Application Priority Data

Jan. 13, 2005 (BE) ..... 2005/0022

(51) Int. Cl.

| | |
|---|---|
| ***D03D 39/06*** | (2006.01) |
| ***D03D 39/02*** | (2006.01) |
| *D03D 13/00* | (2006.01) |
| *D03C 3/00* | (2006.01) |

(52) U.S. Cl. ..... 139/2; 139/10; 139/21; 139/35; 139/44; 139/59

(58) Field of Classification Search ..... 139/2, 139/9, 10, 7 A, 21, 35, 37, 44, 59–62, 86–88
See application file for complete search history.

(56) References Cited

U.S. PATENT DOCUMENTS

| | | | | |
|---|---|---|---|---|
| 1,437,682 | A * | 12/1922 | Renard et al. | 139/4 |
| 1,472,459 | A * | 10/1923 | Clark | 139/9 |
| 1,786,667 | A * | 12/1930 | Lyle | 139/336 |
| 1,997,045 | A * | 4/1935 | Dacey | 139/9 |
| 2,023,016 | A * | 12/1935 | Hall | 139/60 |
| 2,226,217 | A * | 12/1940 | Brown | 139/8 |
| 2,728,132 | A | 12/1955 | Shattuck et al. | |
| 3,833,024 | A * | 9/1974 | Evans et al. | 139/2 |
| 3,875,883 | A | 4/1975 | Eberwein et al. | |
| 5,588,383 | A | 12/1996 | Davis et al. | |
| 2003/0145897 | A1 * | 8/2003 | Burton | 139/37 |
| 2003/0150505 | A1 * | 8/2003 | Burton | 139/7 A |
| 2006/0150379 | A1 * | 7/2006 | Bruynoghe et al. | 28/212 |

FOREIGN PATENT DOCUMENTS

| | | |
|---|---|---|
| EP | 0385606 | 9/1990 |
| WO | WO 00/27532 | 5/2000 |

* cited by examiner

*Primary Examiner*—Bobby H Muromoto, Jr.
(74) *Attorney, Agent, or Firm*—James Creighton Wray; Clifford D. Hyra

(57) ABSTRACT

A yarn guiding device for a weaving machine (1) has at least one yarn guide (2) with an input side (3) which is provided to be situated at a yarn supply (4), and an output side (5) which is provided to be connected to a connecting panel (6) by means of a connecting unit (11). The connecting unit (11) is provided to connect the output sides (5) of at least two yarn guides (2) to the connecting panel (6). A weaving machine, more specifically an Axminster weaving machine or a tufting machine is provided with such a yarn guiding device.

15 Claims, 3 Drawing Sheets

YARN GUIDING DEVICE FOR A WEAVING MACHINE AND WEAVING MACHINE PROVIDED WITH SUCH A YARN GUIDING DEVICE

This application claims the benefit of Belgian Application No. 2005/0022 filed Jan. 13, 2005, which is hereby incorporated by reference in its entirety.

BACKGROUND OF THE INVENTION

On the one hand, the invention relates to a yarn guiding device for a weaving machine comprising at least one yarn guide which is provided to be situated at a yarn supply, and an output side which is provided to be connected to a connecting panel by means of a connecting unit. On the other hand, the invention relates to a weaving machine, more specifically an Axminster weaving machine or a tufting machine that is provided with such a yarn guiding device.

With multi-color weaving and tufting, for instance a carpet, most of the time the different pile warp yarns are supplied from a yarn supply, for instance, a bobbin creel, to a device selecting the pile warp yarns in accordance with the pattern desired or bringing the yarns into a position by means of which it will be possible to realize the effect that is desired. With a face-to-face weaving technique the pile warp yarn has to be kept under stress in order to:

- allow for an appropriate shed forming, because of which this stress will enable the pile warp yarns to cross other yarns and possibly also spacers when changing their positions;
- to cause the pile warp yarns to be recuperated and to maintain a sufficient stress in the pile warp yarns by applying weights to these pile warp yarns on the bobbin creel side, in order to return the pile warp yarn back to the bobbin in case the positions of the pile warp yarn will be changed.

However, with Axminster weaving and tufting, this stress is not required and moreover, it is not wanted, enabling more delicate pile warp yarns to be used. With Axminster weaving and tufting, the stress in the pile warp yarn should be kept as low as possible when supplying it to the pattern selection elements. Therefore, with Axminster weaving and tufting, it is known to supply the pile warp yarns to the Axminster weaving and tufting machine, from the yarn supply through a flexible hose or yarn guide (likewise called tubes).

Such yarn guides are described in WO 00/27532 and in GB 2 361 249.

For such yarn guides, synthetic materials are used which, in combination with pile warp yarns, will cause a minimal building up of stress. The use of such yarn guides, in order to guide the pile warp yarns to the area where the fabric is formed has the following functions:

- to properly define the path the pile warp yarns have to follow and to provide them with few and gentle changes of direction in order to prevent different pile warp yarns from getting entangled;
- to maintain the stress required to bring pile warp yarns into the shed forming area as low as possible, in order to reduce pile warp yarn breakage and to allow the use of delicate pile warp yarns;
- to enable the pile warp yarns to be easily blown through from the bobbin creel to the part of the machine where the pile warp yarns are selected. This will simplify the operation of charging the bobbin creel when starting up the Axminster or tufting machine.

On the side of the machine, the yarn guides are supplied and attached to a perforated plank (connecting panel) in the immediate vicinity of the elements of the machine where the pile warp yarns are selected and supplied. Thus, for instance, a connecting panel (likewise called a collecting panel) is used in an Axminster weaving machine which is installed above the selection elements and where each selector element is containing each type of pile warp yarn, and, by taking up a well defined position, is presenting to the gripper the pile warp yarn determined in accordance with the pattern desired in order to provide this fabric with this pattern. Most of the time, the yarn guides are connected to the connecting panel by making use of an accessory (connecting unit), for instance a ferrule. A ferrule is a ring made of metal, connected to the extremity of the yarn guide. The choice of metal as the material for the ferrule has the advantage that static charges may be conducted away from the yarn guides. One of the conditions here is that the connecting panel is likewise made of steel or of another conductive material.

The dimensions of the yarn guides and the method of connecting them will determine the density of the perforations and the dimensions of the connecting panel. At the transition of the supply, mostly perpendicular, of the yarn guides with the pile warp yarns on the connecting panel towards the position in the selection element, the pile warp yarn may be submitted to a change of direction. For an adequate supply of the pile warp yarns to the selection elements, this angle, at which the direction of the pile warp yarns will change, should not exceed a maximum admissible value. This means that the greater the distance between the perforations in the connecting panel is, the higher the position of the connection panel should be situated, the longer the path will be for the pile warp yarns to cover without any guidance by a yarn guide. Because of this a situation of the connecting panel up to 1.5 m above the working height of the weaver or tufter can occur, thus making it more difficult to pick up a pile warp yarn which has been blown through. Such a height has the additional disadvantage that a large number of pile warp yarns from the bobbin creel has to be guided upwards first, and then be moved downwards again to the selection elements. This has a particularly disadvantageous influence on the building up of any stress in the pile warp yarn. It will cause a high stress in the pile warp yarns, which indeed should be avoided as already explained before.

SUMMARY OF THE INVENTION

It is a purpose of the invention is to provide a yarn guiding device in accordance with the preamble of the first claim, wherein the density of the perforations in the connecting panel may be increased, such that the connecting panel may be situated closer to the weaver or tufter.

This purpose of the invention is attained by providing a yarn guiding device for a weaving machine, comprising at least one yarn guide with an input side which is provided to be situated at a yarn supply, and an output side which is provided to be connected to a connecting panel by means of a connecting unit, wherein the connecting unit is provided to connect the output sides of at least two yarn guides to the connecting panel.

In this way, the density of the yarn guides on the connecting panel may be increased. This means that the necessary surface of the connecting panel can be reduced by 15 to 25%. This means small angles of inclination for the changes of direction of the pile warp yarns at the transition from the connecting panel to the selection element. This will enable the connecting panel to be lowered, because of which the weaver or the tufter will benefit from having an easier access to the perforated plank. This will have the additional advantage that fewer pile warp yarns have to be moved upwards before moving them downwards again towards the selection elements and that those pile warp yarns which first have to be moved upwards will have to be moved upwards along a path which is shorter. All this means that less stress will be built up in the pile warp yarns.

In a first preferred embodiment of a yarn guiding device for a weaving machine according to the invention, the connecting panel is situated between the output sides of the yarn guides and the connecting unit.

In a second preferred embodiment of a yarn guiding device for a weaving machine according to the invention, the connecting unit and the output sides of the yarn guides are situated on the same side of the connecting panel.

At the same time, in an advantageous embodiment of a yarn guiding device for a weaving machine according to the invention, the connecting unit is provided to connect separate yarn guides.

Another disadvantage of the known Axminster weaving machines or tufting machines is that such a machine may be provided with 20000 pile warp yarns all across its width, each pile warp yarn having to be supplied from the bobbin creel to the machine by means of such a yarn guide. This will require an enormous amount of energy and it will be very expensive to install these yarn guides and to connect them to the connecting panel.

An additional purpose is to provide a yarn guiding device having one or more characteristics of the present invention, but for which the time to install these yarn guides for a weaving machine will be reduced.

This aim is attained by providing a yarn guiding device according to the present invention in which at least two of the yarn guides mentioned are connected to one another.

By directly connecting the yarn guides to one another, only a limited number of operations will be required to install the yarn guides and to connect them to the connecting panel. This means a great advantage by reducing the time needed to install the yarn guides. Moreover, such partly or entirely interconnected yarn guides have the advantage that their stiffness will be increased with respect to separate yarn guides, so that the path each separate yarn will have to follow, will be more the same for all yarns, so that it will be easier to regulate a path for the yarns, because of which strong changes of direction for a short distance will be avoided. Also, in the course of time, the positions of the yarn guides will change less when they have been connected to one another. Therefore it will be possible to maintain the stress, built up in the pile warp yarns, at a low level.

The connecting unit in a yarn guiding device for a weaving machine according to the invention, may be provided to connect the yarn guides by means of a clipping system on the one hand, or on the other hand the connecting unit may be provided with one or several cavities in order to slide in the yarn guides, the cavities being carried out in such a manner that the yarn guides, after they have been inserted, will become fixed in the cavities.

When the yarn guides are directly connected to one another, and moreover will be connected to one another all along their entire length, they will be preferably provided in such a manner that they may be separated for part of their length.

This has the advantage that when installing a number of yarn guides connected to one another, for instance 4 or 8 yarn guides, the bobbin creel will be reached, the separate yarn guides each will be connected to a bobbin situated in the bobbin creel one behind the other. In such a case the advantage will consist in being able to separate yarn guide after the other and possibly to shorten it in order that each yarn guide will end up at the right bobbin.

On the one hand, in an advantageous embodiment of a yarn guiding device for a weaving machine according to the invention, the yarn guides may be connected to one another in one single layer.

On the other hand, in an advantageous embodiment of a yarn guiding device for a weaving machine according to the invention, the yarn guides may be connected to one another in two or more layers.

In a further preferred embodiment of a yarn guiding device for a weaving machine according to the invention, the connecting unit is provided in such a manner that it may be inserted into a cavity of the connecting panel, after which it becomes fixed in this cavity after it has been inserted.

In a further preferred embodiment of a yarn guiding device for a weaving machine according to the invention, the connecting unit is carried out in such a manner that it may be hooked onto the connecting panel by means of a clipping system.

In an advantageous embodiment of a yarn guiding device for a weaving machine according to the invention, the connecting unit is carried out as a set of connecting units which have been provided to connect the output sides of the yarn guides.

This will enable a quick and simple assembling of combined yarn guides and connecting units.

In the following detailed description, the characteristics and advantages of a yarn guiding device for a weaving machine according to the invention and an Axminster weaving machine provided with a yarn guiding device according to the invention, which have been mentioned before, will be further clarified. The intention of this description is only to further explain the general principles of the present invention, therefore nothing in this description may be interpreted as being a restriction of the field of application of the present invention or of the patent rights demanded for in the claims.

BRIEF DESCRIPTION OF THE DRAWINGS

In this description, by means of reference numbers, reference will be made to the attached FIGS. 1 up to and including 4 of which.

DETAILED DESCRIPTION OF THE PREFERRED EMBODIMENTS

Figure 4:
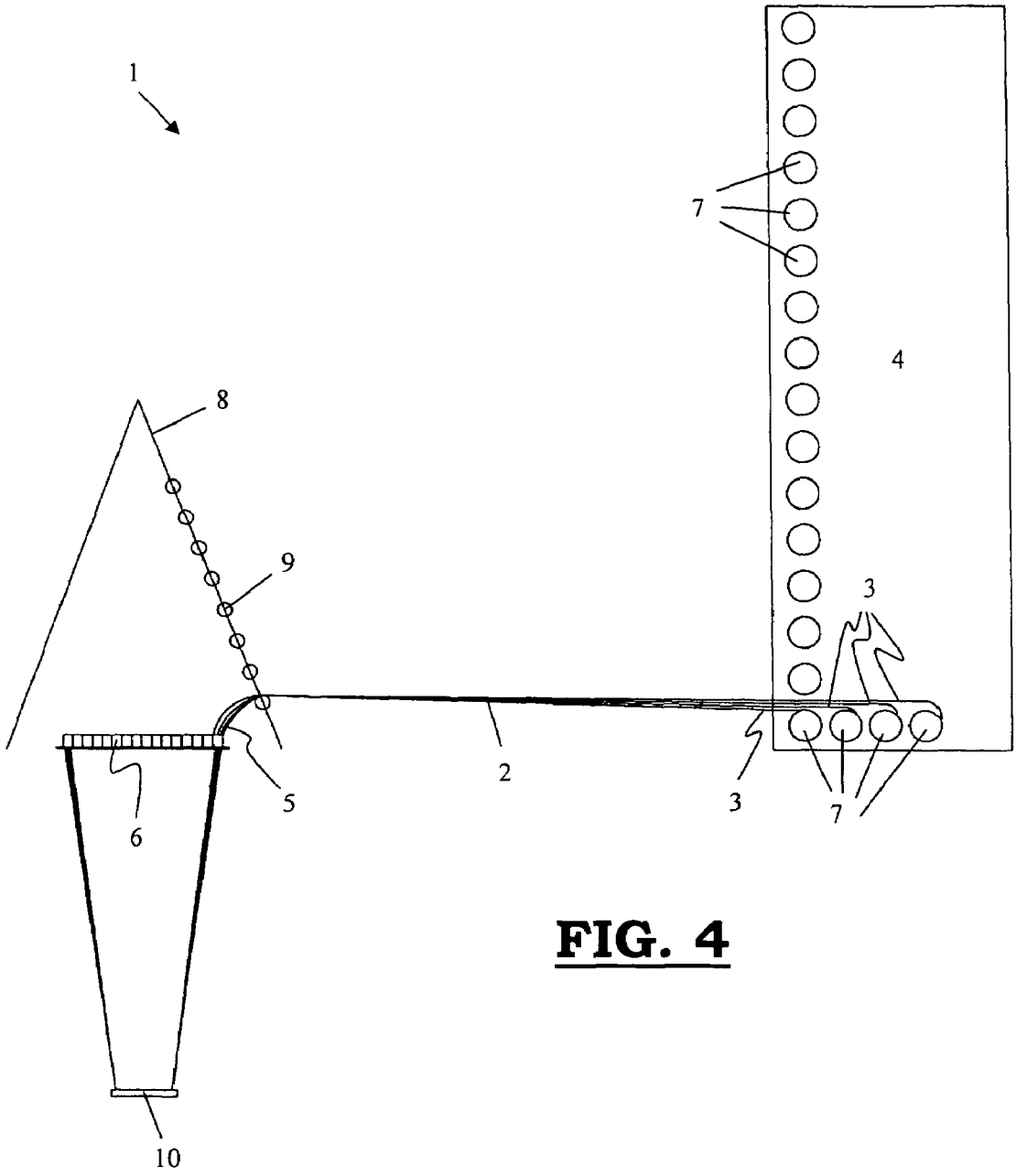
FIG. 4 is a schematic side view of an Axminster weaving machine and a bobbin creel with a schematic indication of the path of the yarn guides.

As represented in FIG. 4, a yarn guiding device (1) according to the invention for an Axminster weaving machine is consisting of at least one yarn guide (2) with an input side (3) which is provided to be installed next to a yarn supply (4), for instance, a bobbin creel, and an output side (5) which is provided to be connected to a connecting panel (6) by means of a connecting unit. A pile warp yarn arriving from a bobbin (7) is led into a yarn guide (2), shortly after it has been unrolled from the bobbin (7) in the bobbin creel (4). The yarn guide (2) is extending towards the Axminster weaving machine (1). Through a reversing grid (8), into which guiding bars (9) have been installed, the yarn guides (2) are derived from a practically horizontal direction to a practically vertical direction to be connected to the connecting panel (6). Once the pile warp yarns have extended through the connecting panel (6), they are conducted to a selection element (10). It is also possible to use such a yarn guiding device with other machines, such as a tufting machine, for instance.

In a yarn guiding device according to the invention, a connecting unit is provided to connect the output side of at least two yarn guides (2) to the connecting panel (6). The connecting unit may be provided to connect 2, 4, 6, 8, 12 or any other number of yarn guides (2).

There are several possibilities to connect a connecting unit to the connecting panel (6):

Either the connecting panel (6) is situated between the output sides (5) of the yarn guides (2) and the connecting unit, the connecting unit being installed first at the lower end of the connecting panel (6), and the yarn guides at the top of the connecting panel (6) are connected to the connecting unit, causing the whole to become fixed;

Or the connecting unit and the output sides (5) of the yarn guides (2) are situated on the same side of the connecting panel (6), the connecting unit being connected to the connecting panel (6) from above.

Figure 1A:
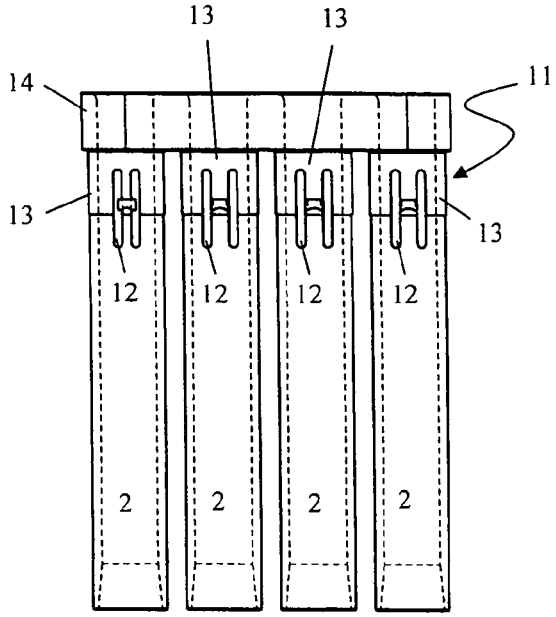
FIG. 1*a* is a top view of a common connecting unit which is provided for connecting 4 separate yarn guides, the yarn guides being connected to the connecting unit.
Figure 1B:
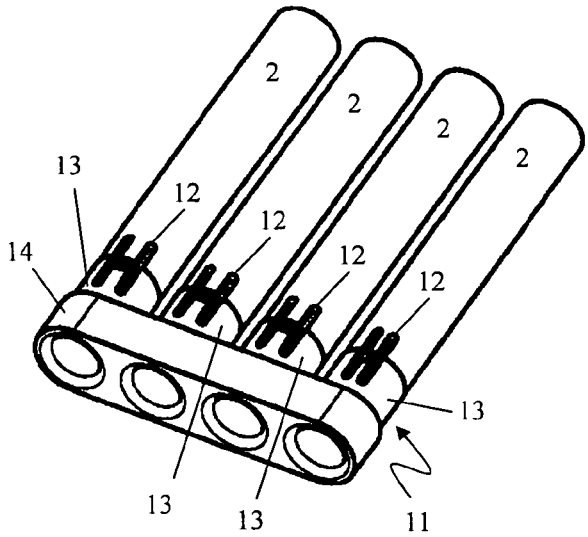
FIG. 1*b* is a perspective view of a common connecting unit as represented in FIG. 1*a;*
Figure 2:
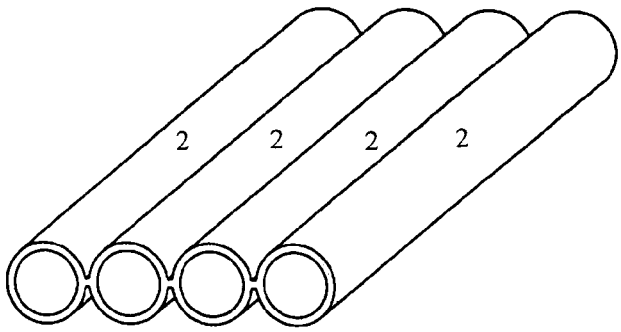
FIG. 2 is a perspective view of 4 guides being connected to one another which have been produced as a whole.

As represented in the FIGS. 1*a* and 1*b*, the connecting unit (11) may be provided to connect yarn guides (2) separately. The connecting panel (6) is not represented in these FIGS. 1*a* and 1*b*, but is situated between the connecting unit (11) and the system by means of which the yarn guides (2) are connected to the tubes (13) of the connecting unit (11). The connecting panel (6) is herewith carried out with openings through which the tubes (13) of the connecting unit (11) are extending, whereas the flanged part (14) of the connecting unit (11) is situated outside the connecting panel (6). On the other hand, the yarn guides (2) may also be connected to one another, as represented in FIG. 2. The connecting unit (11), as represented in the FIGS. 1*a* and 1*b*, is provided to connect yarn guides (3) by way of a clipping system (12). Another system to connect the yarn guides (3) to the connecting unit (11), which is represented in FIG. 3, is to provide the connecting unit (11) with one or more cavities for the yarn guides (2) to be inserted into, the cavities being carried out such that the yarn guides (2) become fixed after having been inserted in the cavities.

In case the yarn guides (2) are directly connected to one another, and moreover, are connected to one another along their entire length, preferable they should be provided in such a manner that they may be separated again for part of their length.

Figure 3:
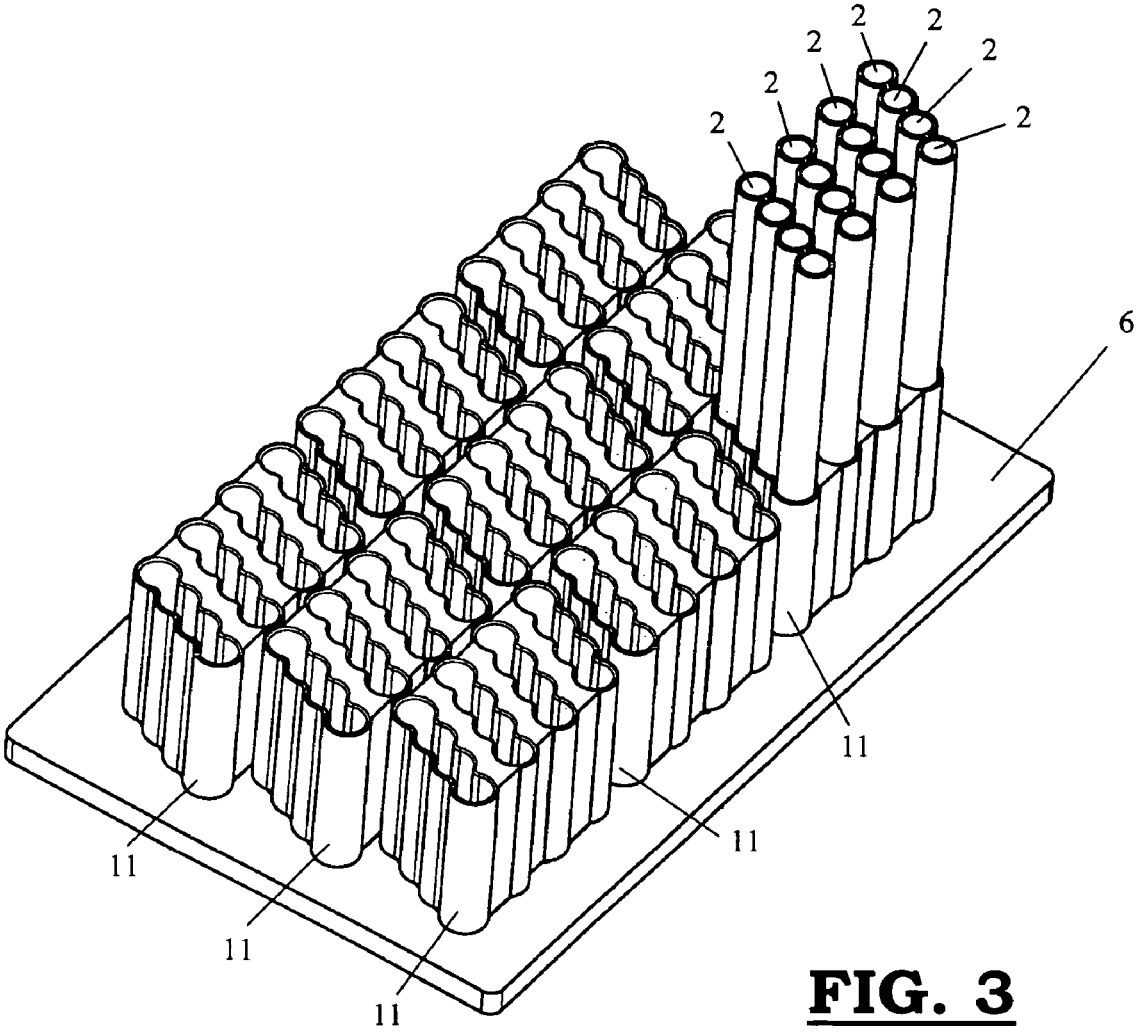
FIG. 3 is a perspective view of part of a connecting panel which has been carried out with several connecting units being provided to connect 4 yarn guides connected to one another.

It is possible to connect the yarn guides (2) to one another in one single layer, as represented in the FIGS. 2 and 3, or they may be connected to one another in two or more layers (not represented in the figures).

On the one hand, the connecting unit (11) may be carried out to be inserted into a cavity of the connecting panel (6), and after having been inserted into the cavity, they will become fixed in this cavity. On the other hand, the connecting unit (11) may be carried out such that it may be hooked on to the connecting panel (6) by means of a clipping system (12). Therewith, the connecting panel (6) is provided as a kind of grid into which the common connecting units (11) may be hooked. It is also possible to carry out the connecting panel (6) as a set of connecting units (11) which are provided to connect the output sides (5) of the yarn guides (2).

The connecting units (11) may be carried out in metal, which has the advantage that the static charges of the yarn guides (2) will be conducted away from the yarn guides. A condition being that the connecting panel (6) is made of steel or of another conductive material. However, the connecting units (11) can be made of synthetic material, provided an additive is added to render the connecting units (11) and/or the yarn guides (2) antistatic.

The invention claimed is:

1. Yarn guiding device for a weaving machine (1), comprising at least two yarn guides (2) each having an input side (3) which is provided to be situated at a yarn supply (4) and an output side (5) fixedly connected during operation to a connecting panel (6) by means of a connecting unit (11), characterized in that the at least two yarn guides are interconnected along a major part of their length and their output sides are jointly connected to a connecting panel by means of a connecting unit (11).

2. Yarn guiding device according to claim 1, characterized in that the connecting panel (6) is situated between the output sides (5) of the yarn guides (2) and the connecting unit (11).

3. Yarn guiding device according to claim 1, characterized in that the connecting unit (11) and the output sides (5) of the yarn guides (2) are situated on the same side of the connecting panel (6).

4. Yarn guiding device according to claim 1, characterized in that the connecting unit (11) is provided to connect the yarn guides (2) by means of a clipping system (12).

5. Yarn guiding device according to claim 1, characterized in that the connecting unit (11) is provided with one or several cavities in order to slide in the yarn guides (2), the cavities being carried out in such a manner that the yarn guides (2) will become fixed after having been inserted.

6. Yarn guiding device according to claim 1, characterized in that the yarn guides (2) are provided in such a manner that it will be possible to separate them for part of their length.

7. Yarn guiding device according to claim 1, characterized in that the yarn guides (2) are connected to one another in one single layer.

8. Yarn guiding device according to claim 1, characterized in that the yarn guides (2) are connected to one another in two or more layers.

9. Yarn guiding device according to claim 1, characterized in that the connecting unit (11) is carried out in such a manner that it may be inserted into a cavity of the connecting panel (6) after which it becomes fixed in this cavity after it has been inserted.

10. Yarn guiding device according to claim 1, characterized in that the connecting unit (11) is carried out in such a manner that it may be hooked on to the connecting panel (6) by means of a clipping system (12).

11. Yarn guiding device according to claim 1, characterized in that the connecting panel (6) is carried out as a set of connecting units (11) which are provided to connect the output sides (5) of the yarn guides (2).

12. Weaving machine, characterized in that the weaving machine (1) is provided with a yarn guiding device according to claim 1.

13. Weaving machine according to claim 12, characterized in that the weaving machine is an Axminster weaving machine (1).

14. Weaving machine according to claim 13, characterized in that the weaving machine is a tufting machines (1).

15. Yarn guiding device according to claim 6, characterized in that the yarn guides (2) are connected to one another along their entire length.

* * * * *